US008973340B2

(12) United States Patent
Weaver

(10) Patent No.: US 8,973,340 B2
(45) Date of Patent: Mar. 10, 2015

(54) APPARATUS AND METHOD OF PRODUCT WRAPPING

(75) Inventor: J. Michael Weaver, Madison, CT (US)

(73) Assignee: Standard Knapp Inc., Portland, CT (US)

( * ) Notice: Subject to any disclaimer, the term of this patent is extended or adjusted under 35 U.S.C. 154(b) by 411 days.

(21) Appl. No.: 12/566,281

(22) Filed: Sep. 24, 2009

(65) Prior Publication Data

US 2011/0067356 A1 Mar. 24, 2011

(51) Int. Cl.
*B65B 49/12* (2006.01)

(52) U.S. Cl.
USPC ..... 53/465; 53/461; 53/203; 53/210; 53/220; 53/233

(58) Field of Classification Search
USPC ..... 53/461, 464, 465, 466, 203, 210, 218, 53/220, 221–224, 228, 232, 233
See application file for complete search history.

(56) References Cited

U.S. PATENT DOCUMENTS

| | | | | |
|---|---|---|---|---|
| 4,155,213 | A * | 5/1979 | Blanton et al. | 53/587 |
| 4,408,439 | A * | 10/1983 | Anderson | 53/461 |
| 4,683,704 | A * | 8/1987 | Vorachek et al. | 53/461 |
| 4,953,336 | A * | 9/1990 | Lancaster et al. | 53/556 |
| 5,203,146 | A * | 4/1993 | Gambetti | 53/557 |
| 5,426,913 | A * | 6/1995 | Iriarte | 53/389.2 |
| 5,463,846 | A * | 11/1995 | Gambetti | 53/465 |
| 5,469,688 | A * | 11/1995 | Dunbar et al. | 53/419 |
| 6,098,371 | A * | 8/2000 | Cassoli et al. | 53/234 |
| 6,474,041 | B1 * | 11/2002 | Gambetti | 53/141 |
| 6,546,832 | B2 * | 4/2003 | Greenwald et al. | 82/112 |
| 6,722,103 | B2 * | 4/2004 | Gambetti | 53/411 |
| 6,739,115 | B1 * | 5/2004 | Malini | 53/588 |
| 7,328,550 | B2 | 2/2008 | Floding et al. | |
| 7,328,554 | B1 * | 2/2008 | Cerf | 53/465 |
| 7,533,768 | B2 | 5/2009 | Floding et al. | |
| 8,356,456 | B2 * | 1/2013 | Floding et al. | 53/218 |
| 2002/0062630 | A1 | 5/2002 | Gutche | |

(Continued)

FOREIGN PATENT DOCUMENTS

| | | | |
|---|---|---|---|
| EP | 1205385 | A1 | 9/2001 |
| EP | 1256519 | A1 | 11/2002 |

OTHER PUBLICATIONS

Notification of Transmittal and Written Opinion, Mailed Jun. 8, 2011, International Appln. No. PCT/US2010/050142, Notification of Transmittal 5 Pages, Written Opinion 4 Pages.

(Continued)

*Primary Examiner* — Christopher Harmon
(74) *Attorney, Agent, or Firm* — Cantor Colburn LLP

(57) ABSTRACT

An aim assembly includes a hub movable about a central axis and at least one support operably connected to the hub. At least one arm is operably connected to the at least one support and thereby movable about the central axis in a predetermined path. At least one adjustment mechanism is located at the central axis and is capable of altering the predetermined path during movement of the at least one support about the central axis. A method of operating an arm assembly includes locating at least one hub at a central axis and moving at least one arm about the central axis in a predetermined path. The at least one arm is operably connected to the at least one hub via at least one support. An adjustment mechanism is engaged thereby altering the predetermined path during movement of the at least one arm about the central axis.

20 Claims, 6 Drawing Sheets

(56) References Cited

U.S. PATENT DOCUMENTS

| | | | | |
|---|---|---|---|---|
| 2002/0189204 | A1* | 12/2002 | Gambetti | 53/442 |
| 2003/0089081 | A1* | 5/2003 | Platon | 53/399 |
| 2004/0083689 | A1 | 5/2004 | Floding et al. | |
| 2004/0177597 | A1 | 9/2004 | Dougherty | |

OTHER PUBLICATIONS

Mexican Office Action for MX Application No. MX/a/2012/003438, dated Jun. 11, 2014, pp. 1-5.

* cited by examiner

APPARATUS AND METHOD OF PRODUCT WRAPPING

BACKGROUND

The subject matter disclosed herein generally relates to packaging machines. More specifically, the subject invention relates to a packaging machine having an adjustable wand.

Packaging machines typically convey a product or group of products along a pathway, for example, a conveyor. A piece of wrapping material is typically located on the pathway underneath the product. As the product travels along the pathway, am arm, typically called a "wand", is moved in a predetermined path, lifting a trailing portion of the wrapping material over the product and to the front of the product to form a roughly tubular shape of wrapping material around the product. The desired path of the wand depends on the size and shape of the product or group of products to be wrapped in the material. To change the path of the wand to accommodate products of different shapes and sizes, the packaging machine must typically be stopped, and some intervention by an operator, often in the form of changing parts on the packaging machine, must occur to perform the necessary adjustments to the path of the wand. Stoppage of the machine to perform adjustments results in machine downtime which decreases productivity of the packaging machine, and reduces flexibility of usage of the packaging machine. The art would well receive an adjustable wand for a packaging machine whose path is changeable without stopping the machine or requiring manual intervention by an operator.

SUMMARY

Disclosed herein is an arm assembly including a hub movable about a central axis and at least one support operably connected to the hub. At least one arm is operably connected to the at least one support and thereby movable about the central axis in a predetermined path. At least one adjustment mechanism is located at the central axis and is capable of altering the predetermined path during movement of the at least one support about the central axis.

Further disclosed herein is a wrapping machine including a product conveying portion and an arm mechanism disposed at the product conveying portion. The arm mechanism including at least one hub movable about a central axis and at least support operably connected to the at least one hub. At least one arm is operably connected to the at least one support and is thereby movable about the central axis in a predetermined path. At least one adjustment mechanism is located at the central axis and is capable of altering the predetermined path during movement of the at least one support about the central axis.

Further disclosed herein is a method of operating an arm assembly including locating at least one hub at a central axis and moving at least one arm about the central axis in a predetermined path. The at least one arm is operably connected to the at least one hub via at least one support. An adjustment mechanism is engaged thereby altering the predetermined path during movement of the at least one arm about the central axis.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
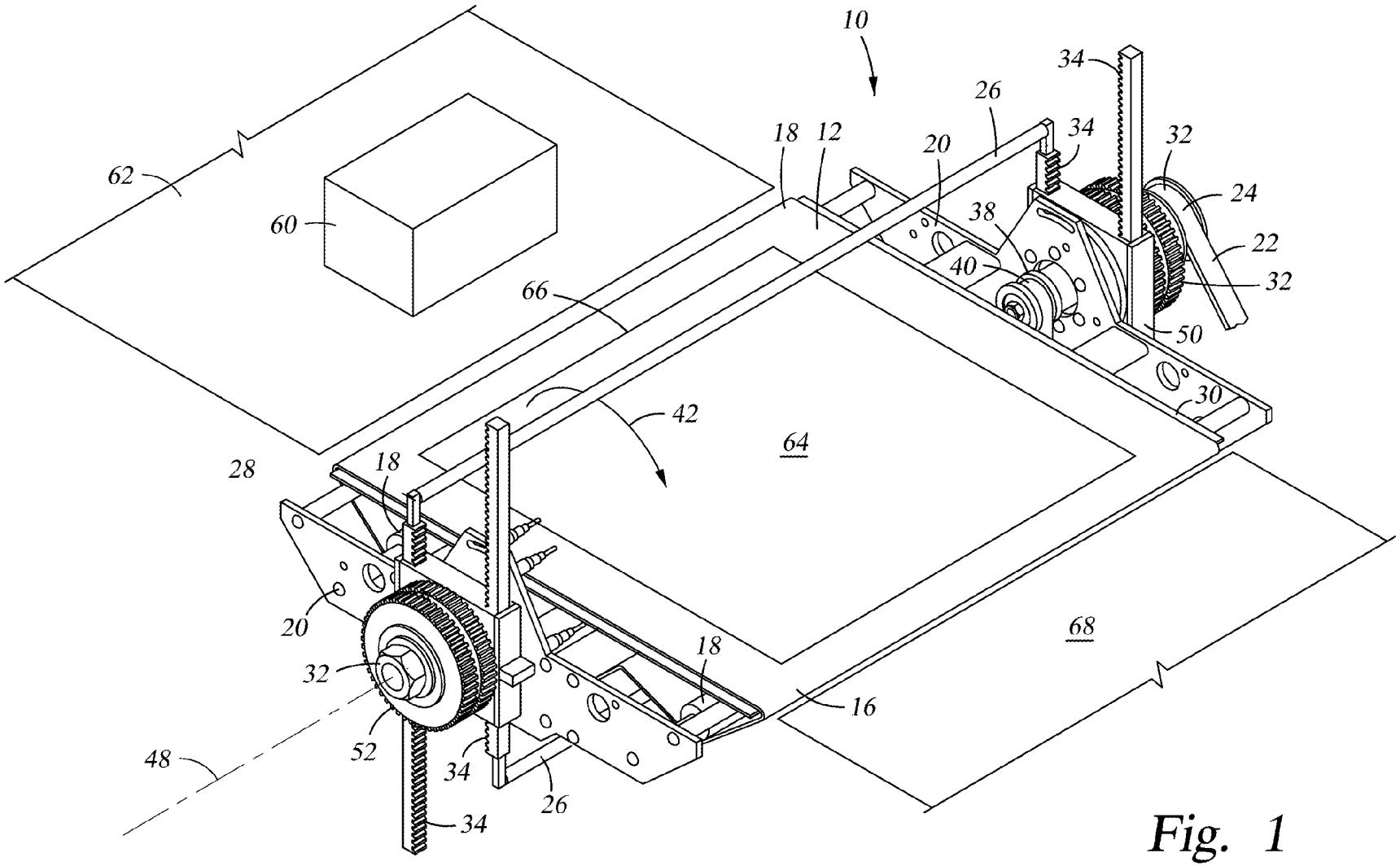
FIG. 1 is perspective view of an embodiment of a packaging machine.

Shown in FIG. 1 is an embodiment of a wrap machine 10. The wrap machine 10 includes a product belt 12 which is formed into a surface to move a product from a first end 14 of the wrap machine 10 to a second end 16 of the wrap machine 10. The belt 12 may be supported by one or more belt rollers 18 which may be rotably secured to a machine frame 20. The belt 12 is driven by, for example, an electric motor (not shown) or the like. In some embodiments, the electric motor is operably connected to a drive belt 22 which urges rotation of one or more drive pulleys 24 to urge the belt 12 over the one or more rollers 18, and other structure of the wrapping machine 10.

Figure 2:
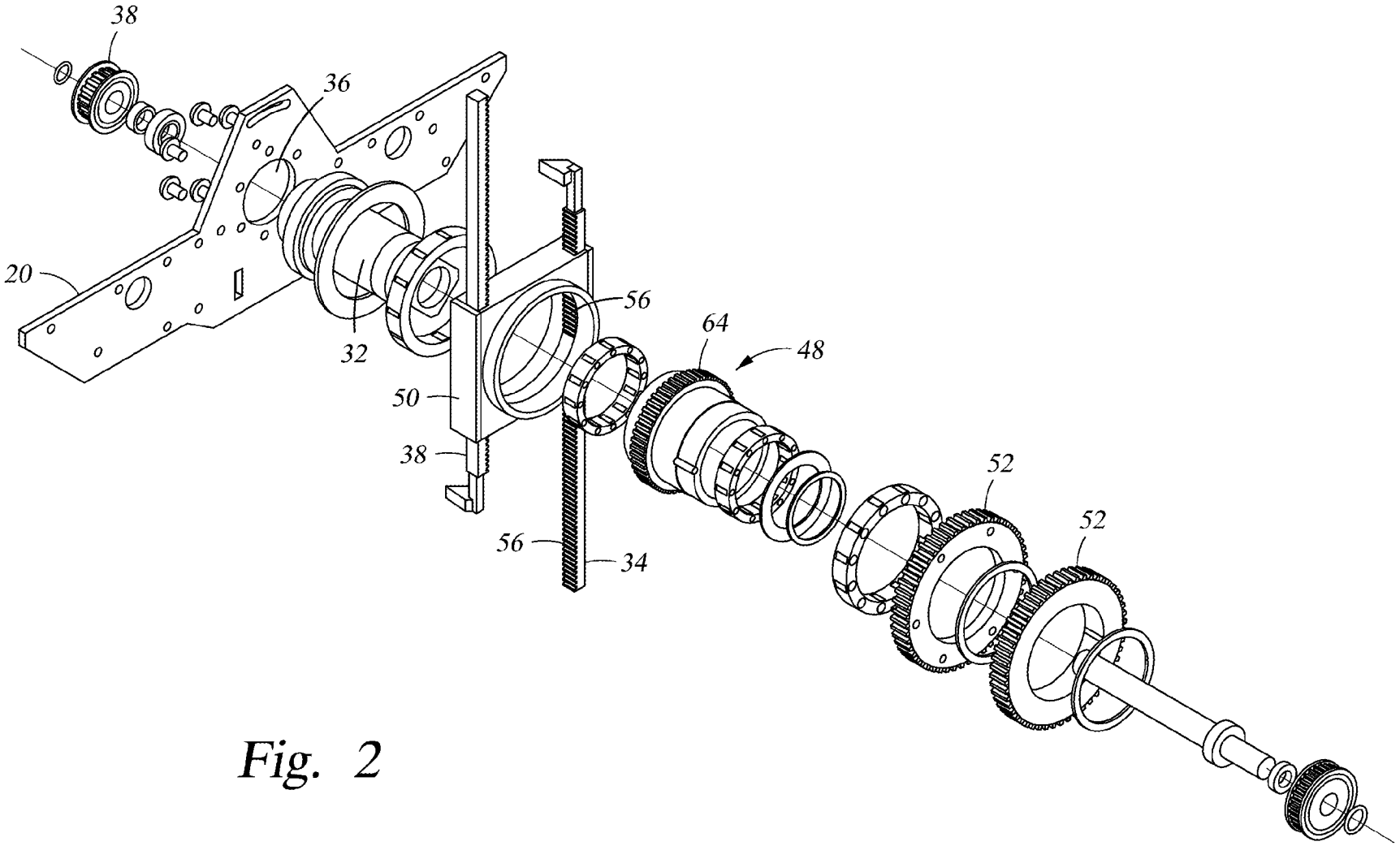
FIG. 2 is a partially-exploded view of an embodiment of a hub of a packaging machine.

The wrap machine 10 includes one or more wands 26. Each wand 26 extends laterally from a first side 28 toward a second side 30 of the belt 12. Each wand 26 is supported at at least one end by a support 34, the support 34 supported at a hub 32 of the wrap machine 10. The wands 26 illustrated in FIG. 1 are supported at two hubs 32 disposed at the first side 28 and the second side 30 of the belt 12, but it is to be appreciated that, in some embodiments, each wand 26 may be supported only at one hub 32. Each hub 32 is rotably connected to the machine frame 20. For example, as shown in FIG. 2, the hub 32 is substantially circular in cross section and extends through a hub hole 36 in the machine frame 20. At least one hub 32 is configured as a drive hub 38. The drive hub 38 is connected to a hub drive 40 (shown in FIG. 1) which may be, for example, a belt or a chain. The hub drive 40 urges rotation of the drive hub 38 which in turn drives the at least one wand 26 through a path 42 over the belt 12. In some embodiments, as shown in FIG. 1, the path 42 may be substantially circular, but other shapes, including elliptical are contemplated within the present scope. Further, as shown in FIG. 1, an axis of rotation 44 of the hub 32 lies in an extension of the surface of the belt 12. In some embodiments, however, the axis of rotation 44 may be disposed either above or below the surface of the belt 12.

To increase flexibility and reduce downtime of the machine 10, a distance 46 of the wand 26 from the axis of rotation 44 is adjustable to accommodate different product sizes and/or shapes. As shown in FIG. 2, each hub 32 includes an adjustment mechanism 48 located in a housing 50. The housing 50 includes support openings 70 through which the supports 34 extend, in a location radially outboard of the adjustment mechanism 48. In some embodiments, the adjustment mechanism 48 may be a wheel, which engages the supports 34 via, for example, friction. In other embodiments, the adjustment mechanism 48 may be a gear which includes a plurality of gear teeth 64 that mesh with corresponding support teeth 56 on the support 34. The adjustment mechanism 48 engages with the supports 34 such that rotation of the adjustment mechanism 48 results in the support 34 moving substantially tangentially along the adjustment mechanism 48 thereby increasing the distance 46 of the wand 26 from the axis of rotation 44. In some embodiments, it may be desired to utilize other quantities of wands 26. For example, some embodiments may utilize a single wand 26. The wand 26 may be adjustable via a single adjustment mechanism 48 at each hub 32 as described above, or other schemes may be utilized. For example, the support 34 may be positioned between two adjustment mechanism 48, which when rotated, result in movement of the support 34 to change the position of the wand 26.

Figure 3:
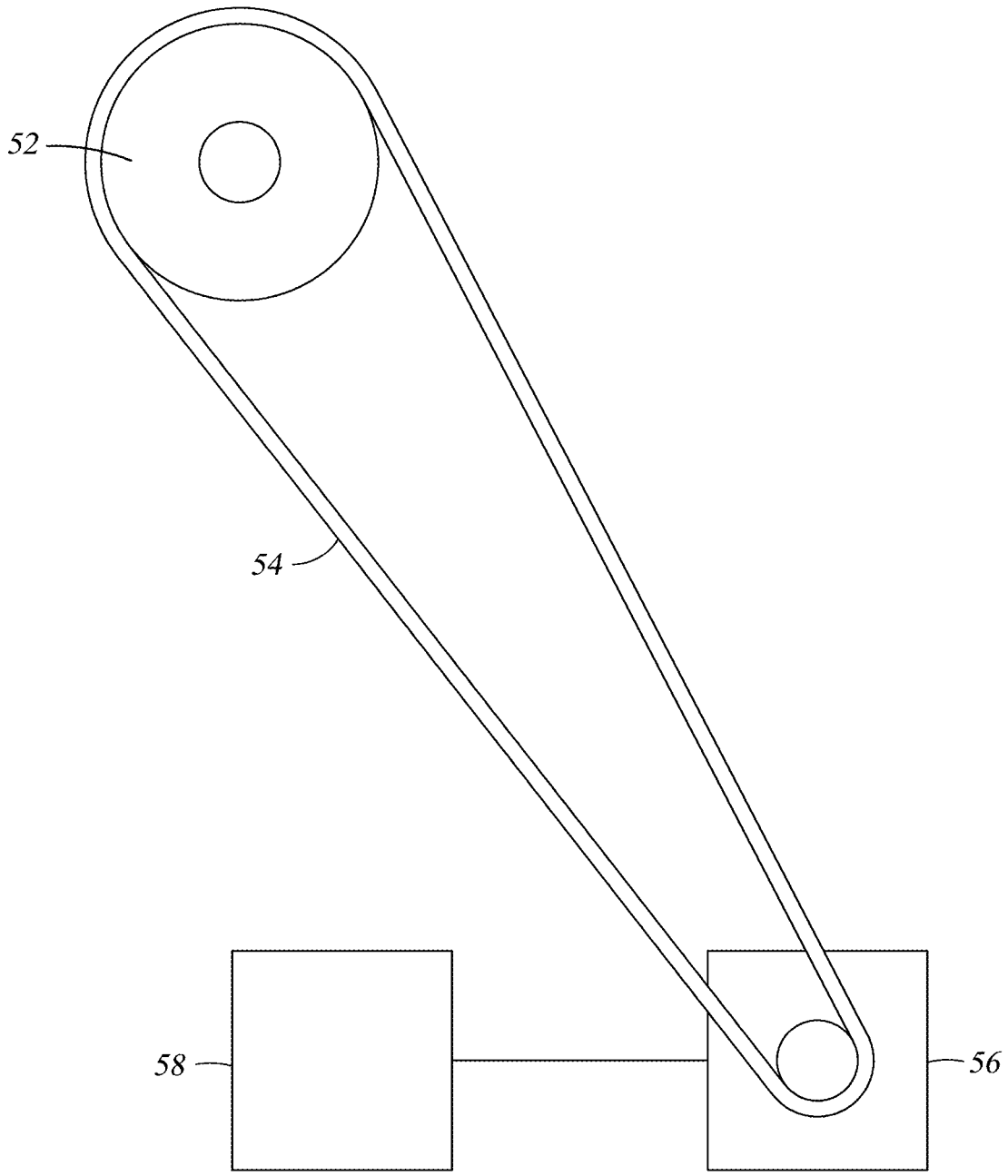
FIG. 3 is a partial end view of an embodiment of a hub drive for a packaging machine.

Referring again to FIG. 2, adjustment of the wand 26 position utilizing the adjustment mechanism 48 and supports 34 may be achieved on the fly during operation of the machine 10. For example, one or more drives 52 are disposed at each hub 32 and, as shown, may be substantially concentric with the adjustment mechanism 48. The one or more drives 52 are, for example, pulleys, gears, servomotors, direct drives, or the like. In an exemplary embodiment, two drives 52, configured as pulleys, are disposed at a hub 32. A first drive 52, in this embodiment the drive 52 closest to the housing 50 is operably connected to the housing 50 such that rotation of the first drive 52 results in rotation of the housing 50. A second drive 52 is operably connected to adjustment mechanism 48. When the second drive 52 is rotated, adjustment mechanism 48 is driven, thus urging movement of the supports 34 positionally in or out of the housing 50. As shown in FIG. 3, the drives 52 are driven by, for example, one or more drive belts 54, which may be belts or chains or the like. The drive belt 54 is driven by, for example, and electric motor 56 or the like. Adjustment of the wand 26 position may then be achieved by rotation of the drive 52 a desired amount at a desired time, and can be accomplished while the machine 10 is in operation. Further, in some embodiments, one or more programmable controllers 58 connected to the electric motor 56 may provide programmed instructions to the electric motor 56 to drive the drives 52 a predetermined amount at predetermined times thereby adjusting the wand 26 position. In further embodiments, the controllers 58 are operatively connected to one or more sensors positioned upstream of the wrapping machine 10 that provide information to the controllers 58 about the size and shape of an approaching product. With this information the controllers 58 are programmed to automatically adjust the wrapping machine 10 to accommodate the approaching product.

Referring again to FIG. 1, the wands 26 may be utilized a part of a wrapping machine 10. Product 60 flows down an upstream conveyor 62 and continues onto the belt 12, on which a layer of wrapping material 64, for example, shrink wrap, has been placed so as to be between the belt 12 and the product 60. As the wand 26 rotates about the axis of rotation 44, the wand 26 lifts an upstream portion 66 of the wrapping material 64 from the belt 12 and over the product 60 to form a roughly tubular shape of wrapping material 64 around the product 60. The product then proceeds onto a downstream conveyor 68 toward, for example, a heating unit (not shown) which shrinks the wrapping material 64 around the product 60. As product 60 of a different size or shape flows to the belt 12, the pulleys 52 may be driven to adjust the position of the wands 26 to properly wrap the product 60.

In an exemplary embodiment, adjustments to the position of the wands 26 are made between individual products 60 to accommodate the approaching product 60. It is to be appreciated, however, that adjustments to the position of the wands 26 can be made at any time. For example, the position may be adjusted substantially continuously such that the path described is a substantially a constant distance from the product 60 to facilitate more smoothly wrapping the product 60. In some embodiments where the product 60 has a flat top, the path 42 may be a substantially straight line over the top of the product 60. In other embodiments, elliptical paths 42 may be used with elliptical products 60 and irregularly shaped profiles 42 may be utilized for irregularly shaped product 60 if so desired.

Figure 4:
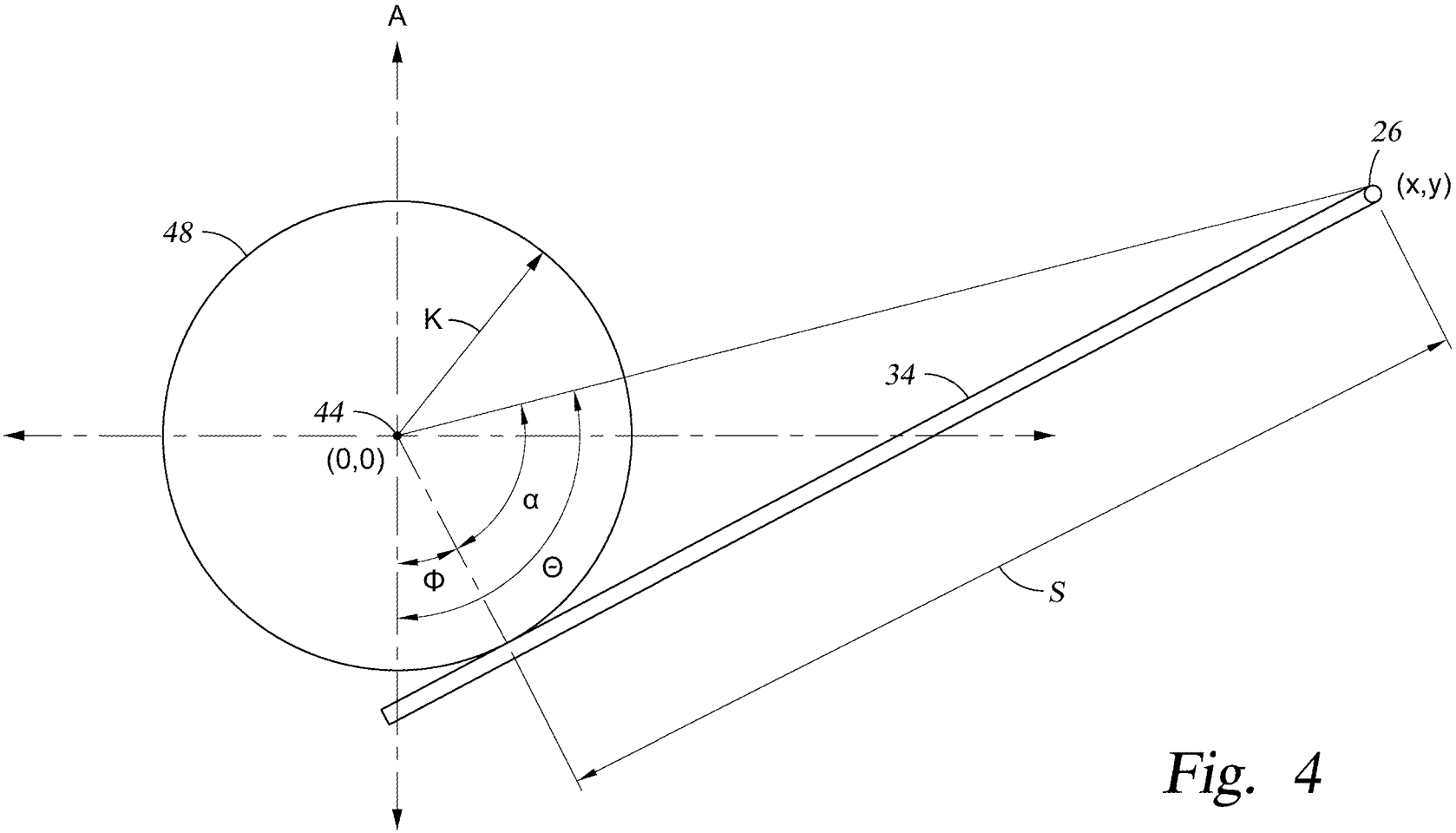
FIG. 4 is a partial end view of an embodiment of a packaging machine.

At any point in time, a position of each wand 26 can be expressed relative to the axis of rotation 44. As shown in FIG. 4, the wand 26 has a position (x,y) relative to the axis of rotation 44 (0,0). The position (x,y) depends on a radius (K) of the adjustment mechanism 48, and effective length (S) of the support 34, and an angular rotation (Φ) of the adjustment drive. Position (x,y) is expressed as:

$$x=K\sin\Phi+S\cos\Phi$$

and $$y=-K\cos\Phi+S\sin\Phi$$

Given a desired position (x,y) of the wand 26, the position (x,y) can be reached by changing the effective length (S) via the adjustment mechanism 48 and by rotation of the hub 32 about the central axis 44. For a particular position (x,y), the effective length (S) of the support 34 is:

$$S=\mathrm{sqrt}(x^2+y^2-K^2)$$

The angular rotation of the hub 32 is:

$$\Phi=\arcsin[(xK+Sy)/(K^2+S^2)]$$

or $$\Phi=\arcsin[(Kx+y*\mathrm{sqrt}(x^2+y^2-K^2))/(x^2+y^2)]$$

An angular position (θ) of the wand 26 is expressed as:

$$\theta=\alpha+\Phi$$

where $$\alpha=S/K \text{ or } \mathrm{sqrt}(x^2+y^2-K^2)/K$$

Utilizing the above equations, given a desired position (x,y) of the wand 26, the necessary effective length (S) and angular rotation (Φ) can be determined. The effective length (S) and angular rotation (Φ) may be utilized by, for example, the controller 58 to drive the wand 26 to a desired position.

Figure 5:
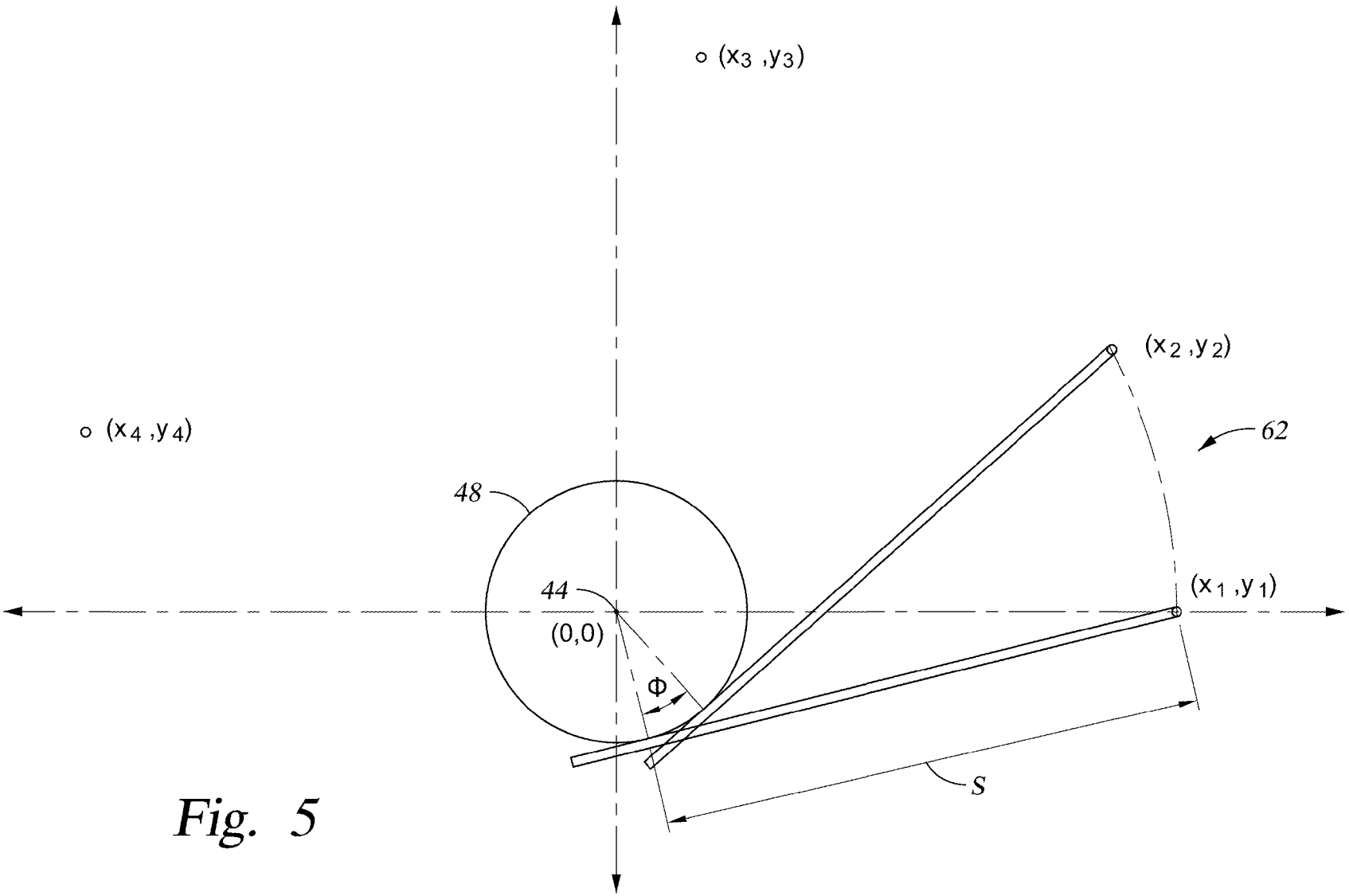
FIG. 5 is another partial end view of the packaging machine of FIG. 4.

As shown in FIG. 5, the path 42 may comprise a number of discreet legs 62 between positions, for example, $(x_1, y_1)$ and $(x_4, y_4)$ via $(x_2, y_2)$ and $(x_3, y_3)$. The movement of the wand 26 from, for example, $(x_1, y_1)$ to $(x_2, y_2)$ is defined by:

$$\Delta S=\mathrm{sqrt}[(x_2-x_1)^2+(y_2-y_1)^2-K^2] \text{ and}$$

$$\Delta\Phi=\arcsin[(K*(x_2-x_1)+(y_2-y_1)*\mathrm{sqrt}((x_2-x_1)^2+(y_2-y_1)^2-K^2))/((x_2-x_1)^2+(y_2-y_1)^2)]$$

Further, each leg 62 may be subdivided into sublegs to further define the motion of the wand 26 between, for example, $(x_1, y_1)$ and $(x_2, y_2)$. In one example where 32 sublegs are utilized between $(x_1, y_1)$ and $(x_2, y_2)$:

$$x_2-x_1=32*\Delta x \text{ and}$$

$$y_2-y_1=32*\Delta y$$

Figure 6:
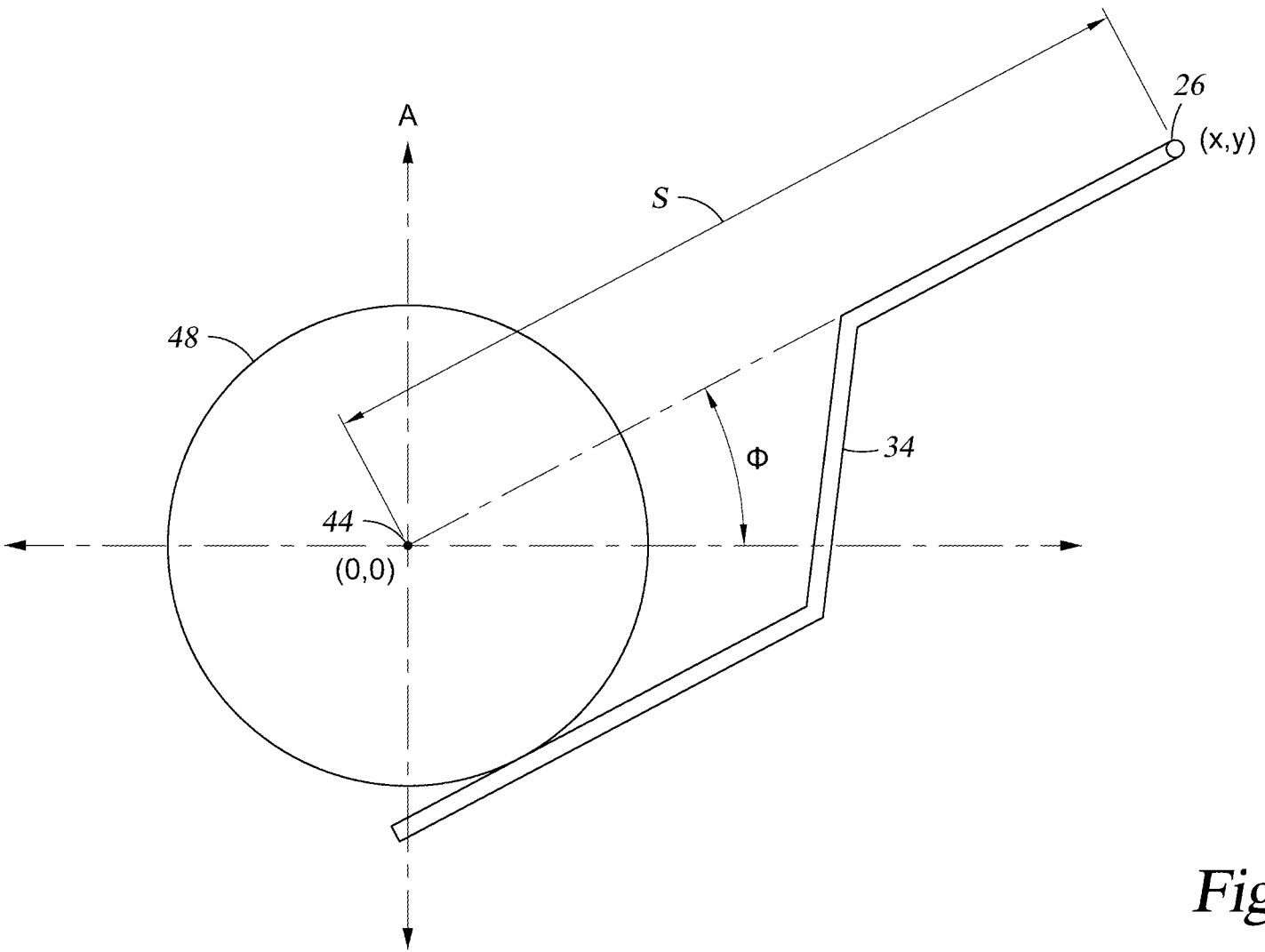
FIG. 6 is a partial end view of another embodiment of a packaging machine.

In one embodiment, as shown in FIG. 6, the support 34 is configured, for example, bent, so that the wand 26 is in direct alignment with the axis of rotation 44. In this embodiment, since there is no need to compensate for the radius (K), the positional calculations are simplified to:

$$X=S\cos\Phi \text{ and}$$

$$Y=S\sin\Phi.$$

For a given position (x, y), the necessary S and Φ are:

$$S=\text{sqrt}(x^2+y^2) \text{ and}$$

$$\Phi=\text{arc tan}(y/x).$$

Similarly, to move the wand 26 between positions $(x_1, y_1)$ and $(x_2, y_2)$:

$$\Delta S=\text{sqrt}((x_2-x_1)^2+(y_2-y_1)^2) \text{ and}$$

$$\Delta\Phi=\text{arc tan}((y_2-y_1)/(x_2-x_1)).$$

It is to be appreciated that use of the adjustment apparatus is not limited to wrapping machines 10. For example, the wands 26, or the supports 34 themselves, may be configured to pick up a product at a first location and move the product to a second location via rotation about the axis of rotation 44 and/or moving the supports 34 to change position of the wands 26.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims

The invention claimed is:

1. An arm assembly comprising:

a hub movable about a central axis;

at least one support operably connected to the hub and rotated about the central axis;

at least one wrapping wand operably connected to the at least one support and thereby movable about the central axis in a predetermined path, the at least one wrapping wand being configured and disposed to position a wrapping material about an article to be wrapped; and at least one adjustment mechanism disposed at the central axis and capable of altering the predetermined path during movement of the at least one support about the central axis by altering an effective length of the at least one support relative to the hub by rotation of the adjustment mechanism about the central axis.

2. The arm assembly of claim 1 wherein the adjustment mechanism engages with the at least one support such that rotation of the adjustment mechanism results in positional movement of the at least one support relative to the adjustment mechanism.

3. The arm assembly of claim 2 comprising at least one drive in operable communication with the adjustment mechanism to urge rotation of the adjustment mechanism.

4. The arm assembly of claim 3 comprising an adjustment motor in operable communication with the at least one drive to urge rotation of the at least one drive.

5. The arm assembly of claim 1 wherein the at least one adjustment mechanism is disposed in operable communication with a programmable controller capable of initiating adjustments of the at least one wrapping wand.

6. The arm assembly of claim 1 wherein the at least one wrapping wand is two wrapping wands.

7. The arm assembly of claim 1 wherein each wrapping wand of the at least one wrapping wand is operably connected to at least two supports.

8. A wrapping machine comprising:

a product conveying portion; and an arm mechanism disposed at the product conveying portion including:

at least one hub movable about a central axis;

at least support operably connected to the at least one hub and rotated about the central axis;

at least one wrapping wand operably connected to the at least one support and is thereby movable about the central axis in a predetermined path; and at least one adjustment mechanism disposed at the central axis and capable of altering the predetermined path during movement of the at least one support about the central axis by altering an effective length of the at least one support relative to the hub by rotation of the adjustment mechanism about the central axis.

9. The wrapping machine of claim 8 wherein the adjustment mechanism engages with the at least one support such that rotation of the adjustment mechanism results in positional movement of the at least one support relative to the adjustment mechanism.

10. The wrapping machine of claim 9 comprising at least one drive in operable communication with the adjustment mechanism to urge rotation of the adjustment mechanism.

11. The wrapping machine of claim 10 comprising an adjustment motor in operable communication with the at least one drive to urge rotation of the at least one drive.

12. The wrapping machine of claim 8 wherein the at least one adjustment mechanism is disposed in operable communication with a programmable controller capable of initiating adjustments of the at least one wrapping wand.

13. The wrapping machine of claim 8 wherein the at least one wrapping wand is two wrapping wands disposed substantially 180 degrees apart relative to the central axis.

14. The wrapping machine of claim 8 wherein the at least one hub is two hubs disposed at opposing sides of the product conveying portion.

15. The wrapping machine of claim 14 wherein each wrapping wand is operably connected to two supports, the two supports operably connected to separate hubs of the two hubs.

16. A method of operating an arm assembly comprising:

disposing at least one hub at a central axis;

moving at least one wrapping wand about the central axis in a predetermined path to position a wrapping material about an article to be wrapped, the at least one arm operably connected to the at least one hub via at least one support rotating about the central axis; and rotating an adjustment mechanism about the central axis thereby altering an effective length of the at least one support relative to the hub to alter the predetermined path during movement of the at least one arm about the central axis.

17. The method of claim 16 wherein altering the effective length of the at least one support comprises:

urging movement of the at least one support via the rotation of the adjustment mechanism thereby changing a length of the at least one support between the at least one wrapping wand and the central axis.

18. The method of claim 17 wherein rotation of the adjustment mechanism is accomplished via rotation of at least one drive in operable communication with the adjustment mechanism.

19. The method of claim 17 comprising urging rotation of the at least one drive via an adjustment motor in operable communication with the at least one drive.

20. The method of claim 16 comprising engaging the adjustment mechanism while moving the at least one wrapping wand about the central axis.

* * * * *